United States Patent [19]

Day, Jr.

[11] 4,035,631

[45] July 12, 1977

[54] PROJECTOR LAMP REFLECTOR

[75] Inventor: Harold R. Day, Jr., Chagrin Falls, Ohio

[73] Assignee: General Electric Company, Schenectady, N.Y.

[21] Appl. No.: 640,901

[22] Filed: Dec. 15, 1975

[51] Int. Cl.[2] ..... F21V 7/02

[52] U.S. Cl. ..... 240/41.35 C; 240/103 R

[58] Field of Search ..... 240/103 R, 41.35 R, 240/41.3, 41.25, 41.35 C, 41.37; 350/125; 352/198; 353/98; 355/67

[56] References Cited

U.S. PATENT DOCUMENTS

| | | | |
|---|---|---|---|
| 1,199,071 | 9/1916 | Heckert | 240/41.35 R |
| 1,258,007 | 3/1918 | Hess | 240/103 R |
| 1,260,387 | 3/1918 | Johanson | 240/103 R |
| 1,639,363 | 8/1927 | Balsillie | 240/41.36 |
| 1,915,842 | 6/1933 | Winkler | 240/103 R |
| 2,088,024 | 7/1937 | Baber | 240/41.35 R |
| 3,153,168 | 10/1964 | Saranga | 240/41.35 R |
| 3,331,960 | 7/1967 | Elmer | 240/103 |
| 3,423,582 | 1/1969 | Elmer | 240/41.37 |
| 3,428,800 | 2/1969 | Levin et al. | 240/41.3 |
| 3,449,561 | 6/1969 | Basil et al. | 240/103 |
| 3,588,493 | 6/1971 | Nordquist | 240/41.37 |
| 3,720,460 | 3/1973 | Wilkinson | 840/41.3 X |
| 3,826,913 | 7/1974 | Downing et al. | 240/103 R |

FOREIGN PATENT DOCUMENTS

| | | | |
|---|---|---|---|
| 365,783 | 12/1938 | Italy | 353/98 |

*Primary Examiner*—Edna M. O'Connor
*Attorney, Agent, or Firm*—Norman C. Fulmer; Lawrence R. Kempton; Frank L. Neuhauser

[57] ABSTRACT

The concave reflecting surface of a projector reflector is shaped to provide a first set of reflecting areas which project a first set of light beams arranged to form a first tightly packed mosaic pattern at a plane, and a second set of reflecting areas which project a second set of light beams arranged to form a second tightly packed mosaic pattern superimposed on said first mosaic pattern.

8 Claims, 5 Drawing Figures

Fig. 1
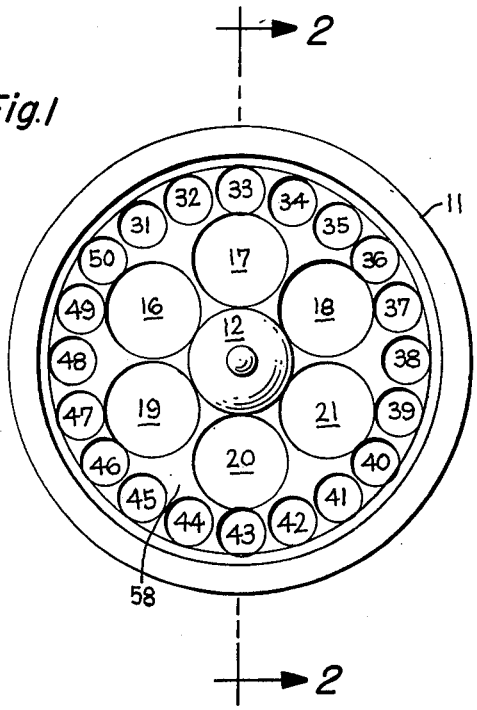
Fig. 3
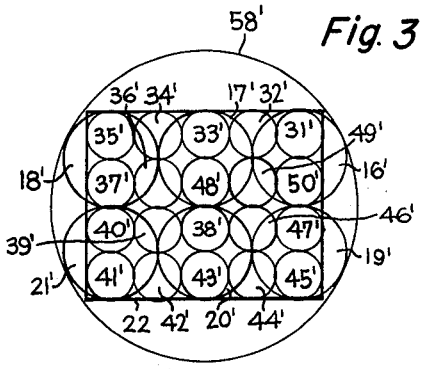
Fig. 4
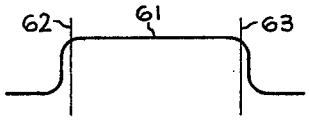
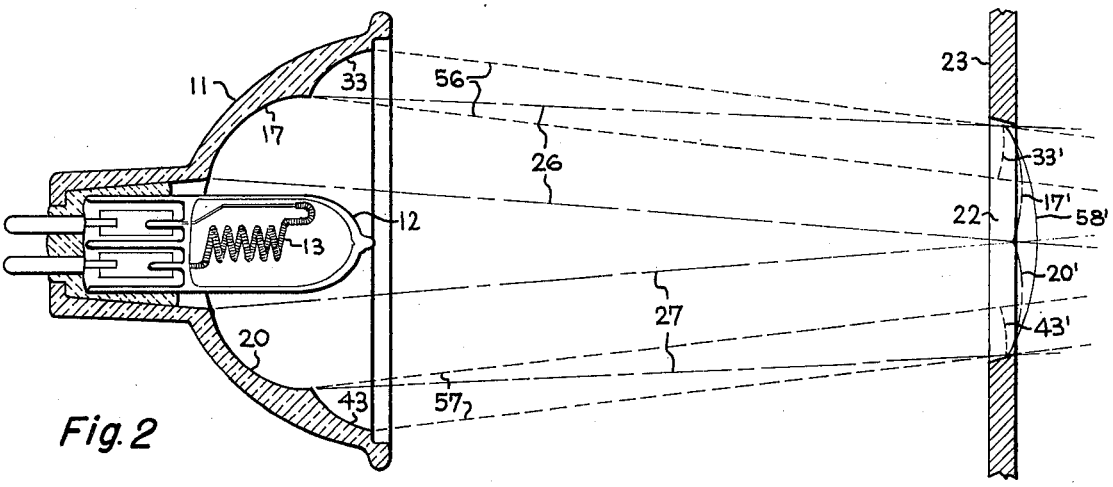
Fig. 2
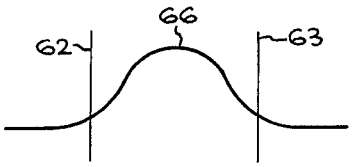
Fig. 5

PROJECTOR LAMP REFLECTOR

CROSS-REFERENCE TO RELATED APPLICATION

Ser. No. 627,085, filed Oct. 30, 1975, Emmett H. Wiley, "Projector Lamp Reflector", assigned the same as this invention.

BACKGROUND OF THE INVENTION

The invention is in the field of projector lamp reflectors wherein it is desired that the projected light pattern be of uniform intensity over the area of an aperture for slides or movie film, and hence of uniform intensity over the surface of a projection screen.

Projector reflectors typically have a concave reflecting surface which is generally circular in planes perpendicular to the reflector's optical axis and is a partial paraboloid, sphere, or ellipsoid, or modifications thereof, in planes passing through the optical axis, i.e., in the radial configuration from the apex to the rim of the reflector. If the radial configuration of the reflecting surface is unmodified ellipsoid or other basic configuration, the projected light beam pattern will tend to have a Gaussian-like distribution in which the center region is brighter than the edges.

Various ways have been devised to modify the basic ellipsoid or other shape of a projector reflector to improve uniformity of projected light distribution. For example, the ellipsoid contour of a reflector can be modified by opening it wider toward the rim so as to spread the projected light beam wider. In another approach, the ellipsoid contour is modified by making it narrower toward the rim. Another way is to shape the reflecting surface in the form of concentric circular bands which project the light in the form of concentric circular bands. Another approach has been to shape different areas of the reflector surface so as to project the light in the form of a mosaic pattern, or in the form of overlapping light beams. For example, the four quadrants of the reflector surface can be shaped to project four light beams each of which fills a different quadrant at the film plane of projection. Also, the four quadrants of the reflector surface can be shaped to project four light beams which overlap one another at the plane of projection.

SUMMARY OF THE INVENTION

A principal object of the invention is to provide a projector reflector which will project light having uniformity of brightness over a plane of projection such as the film aperture of a movie projector or slide projector.

The invention comprises, briefly and in a preferred embodiment, a concave reflector having a first set of concave reflecting areas which project a first set of light beams of given size and arranged to form a first tightly packed mosaic pattern at a film aperture plane, and a second set of concave reflecting areas which project a second set of light beams of given size and arranged to form a second tightly packed mosaic pattern superimposed on said first mosaic pattern. Preferably, the sizes of the light beams in one of the sets thereof are different than in the other set. For example, the light beams in one mosaic can be twice the diameter as those in the other mosaic. Additional sets of reflecting areas can be provided for projecting additional sets of superimposed mosaic light patterns. By thus superimposing two or more mosaic patterns of light beams, the uniformity of brightness is improved over the plane at the film aperture, and hence over the projection screen. The above-described concave reflecting areas can be generally circular, oval, trapezoidal, or other shapes, and they may be arranged to cover the entire reflecting surface of the reflector or only part of it. If the plurality of reflecting areas covers less than the entire reflecting surface, the remaining area of the reflecting surface can be shaped in a conventional ellipsoid or other configuration.

BRIEF DESCRIPTION OF THE DRAWING

FIG. 1 is a front view of a concave projector reflector with a lamp, in accordance with a preferred embodiment of the invention.

FIG. 2 is a side cross-sectional view of the lamp and reflector assembly taken on the line 2—2 of FIG. 1, and also shows a pattern of light beams projected to a film aperture.

FIG. 3 shows a pattern of light beams projected onto the plane of the film aperture by the reflector of FIGS. 1 and 2.

FIG. 4 shows a desired uniform distribution of light intensity across the plane of the aperture.

FIG. 5 shows a non-uniform Gaussian distribution of light intensity across the plane of the film aperture, as produced by a typical conventional uncorrected ellipsoid type reflector.

DESCRIPTION OF THE PREFERRED EMBODIMENT

A concave reflector 11 which may be of glass having its interior surface metallized or coated with multiple layers of materials so as to reflect light and transmit heat, is provided with a lamp 12 positioned therein. The particular lamp shown contains a helical filament 13 positioned at or near the first focus of the reflector 11, which has a generally ellipsoidal cross-section configuration.

In accordance with the invention, the inside surface of the reflector 11 is provided with a plurality of concave reflecting areas 16–21 shaped to provide a plurality of projected light beams which are focused and directed so as to form a tightly packed mosaic pattern of individual lighted areas 16′–21′ (FIG. 3) at the plane of a film aperture 22. FIG. 2 shows the aperture 22, which may be an opening through a metal plate 23, and also indicates the locations of the individual light beams 17′ and 20′ at the aperture 22. Dashed lines 26 indicate the path of light from the reflector area 17 to the aperture area 17′, and dashed lines 27 indicate the path of light from the reflector surface 20 to the aperture area 20′. The reflecting areas 16–21 can conveniently be arranged in a circle around the lamp 12, as shown in FIG. 1.

A second plurality of individual concave reflecting areas 31–50 is provided, and the individual reflecting areas are arranged in a circular manner around the first plurality of reflecting areas 16–21. The reflecting areas 31–50 are shaped and arranged so as to focus and direct a plurality of individual light beams so as to form a tightly packed mosaic of light beams 31′–50′ at the aperture 22 and superimposed upon the mosaic of individual light beams 16′–21′, as shown in FIG. 3. In the embodiment shown, the individual light patterns of the second mosaic are smaller and more numerous than of the first mosaic of light patterns. In FIG. 2, the position of the light pattern 33′ is shown at the aperture 22, and dashed lines 56 indicate the light beam path projected by the reflector area 33. Similarly, the position of the lighted area 43′ is shown at the aperture 22, and dashed lines 57 indicate the path of the light beam projected by the reflecting area 43. The remaining area 58 of the reflector 11 may be of ellipsoidal or modified ellipsoidal configuration, or other desired configuration, so as to provide overall illumination over the entire aperture 22, as indicated by the circle 58′ in FIG. 3 and the line 58′ in FIG. 2.

By providing a reflecting surface of a reflector with pluralities of sets of individual reflecting areas which project sets of light rays to form two or more superimposed mosaic patterns of light, the uniformity of illumination over the area of the aperture 22 is improved, and approaches the ideal uniform brightness curve 61 (FIG. 4) across the area of the aperture between any two opposed edges 62, 63 thereof. FIG. 5 shows the Gaussian curve shape of light pattern which typically occurs over the area of the aperture and between oppositely disposed edges 62 and 63 thereof, whereby the brightness is considerably greater at the center of the aperture than toward its edges, if the reflecting surface is of ellipsoidal or other unmodified geometric configuration.

With the reflector of the invention, each of the individual projected beam areas 16′, 31′, etc., at the plane of the aperture has a somewhat Gaussian distribution of intensity over its surface (approximately as shown in FIG. 5), but because these are relatively small areas distributed over the aperture plane and because of the superimposing of one set of Gaussian light patterns over another, the overall brightness distribution approaches the desired uniformity shown in FIG. 4, perhaps with some "ripples" in the uniformity. Also, each of the individual projected beam areas 16′, 31′, etc., at the plane of the aperture 22 might contain some sort of pattern or image of the filament 13. The reflector areas can be stippled to reduce the visibility of the filament pattern, in well-known manner. The outer reflector areas 31, etc., being relatively farther from the filament and relatively closer to the aperture than the inner reflecting areas 16, etc., tend to project smaller images of the filament than do the inner reflecting areas 16, etc. Consequently, the depths of the concave curvatures of the outer reflecting areas 31, etc., should be made more shallow than those of the inner reflecting areas 16, etc., so that all reflecting areas will project a pattern or image of the filament of a size so as to substantially fill the respective light beam areas 16′, 31′, etc., at the plane of the aperture 22.

If desired, the individual reflecting areas 16–19 and 31–50 can be of trapezoidal or keystone shapes so as to occupy the entire reflecting surface of the reflector 11. Additional individual reflecting areas may be provided, if desired, to provide additional superimposed mosaic patterns of light.

While preferred embodiments and modifications of the invention have been shown and described, various other embodiments and modifications thereof will become apparent to persons skilled in the art and will fall within the scope of the invention as defined in the following claims.

What I claim as new and desire to secure by Letters Patent of the United States is:

1. A projector lamp unit comprising a concave reflector and a light source at a focus point of said reflector, and reflector having a first set of concave reflecting areas arranged to project a first set of light beams of given size from said light source to form a first tightly packed mosiac pattern at a plane, and said reflector having a second set of concave reflecting areas arranged to project a second set of light beams of given size from said light source to form a second tightly packed mosaic pattern superimposed on said first mosaic pattern.

2. A lamp unit as claimed in claim 1, in which said given size of the light beams of said first set thereof is different than said given size of the light beams of said second set thereof.

3. A lamp unit as claimed in claim 1, in which said light beams of both sets have circular cross sections.

4. A lamp unit as claimed in claim 3, in which the light beams of one of said sets thereof have diameters approximately twice as large as those of the other set thereof.

5. A lamp unit as claimed in claim 1, in which said sets of reflecting areas are arranged in concentric circles on the concave surface of said reflector.

6. A lamp unit as claimed in claim 5, in which said reflecting areas are circular, the remaining area of said concave surface having a generally ellipsoidal configuration.

7. A lamp unit as claimed in claim 1, in which said light source is an incandescent lamp having a filament and in which said reflecting areas are provided with concave curvatures such that each reflective area will reflect a pattern from said filament which substantially fills the corresponding light beam area at said plane.

8. A lamp unit as claimed in claim 1, in which each of said concave reflecting areas has a generally ellipsoidal concavity configuration.

* * * * *